US005154042A

United States Patent [19]

Mooney

[11] Patent Number: 5,154,042

[45] Date of Patent: Oct. 13, 1992

[54] FLANK CINCH CONTAINER

[76] Inventor: Scott M. Mooney, 1305 E. Mary St., Ottumwa, Iowa 52501

[21] Appl. No.: 628,455

[22] Filed: Dec. 17, 1990

[51] Int. Cl.[5] ..... B68C 1/20

[52] U.S. Cl. ..... 54/46.1

[58] Field of Search ..... 54/44, 46; 383/84; 224/228, 240, 253

[56] References Cited

U.S. PATENT DOCUMENTS

| | | | |
|---|---|---|---|
| 3,457,702 | 7/1979 | Brown | 54/46 |
| 3,813,017 | 5/1974 | Pimsleur | 224/240 |
| 5,002,214 | 3/1991 | Caranci | 224/228 X |

FOREIGN PATENT DOCUMENTS

| | | | |
|---|---|---|---|
| 403088 | 10/1909 | France | 54/46 |

*Primary Examiner*—Robert P. Swiatek

*Attorney, Agent, or Firm*—Zarley, McKee, Thomte, Voorhees & Sease

[57] ABSTRACT

A flank cinch container includes an upper strap adapted to be passed through the flank cinch ring of a saddle and secured to itself so as to hold the container to the cinch ring. A pair of securing members are provided at the end of the upper strap for wrapping around the flank cinch strap of the saddle so as to further secure the container to the saddle. Below the upper strap are a pair of lower securing members which are adapted to pass around the flank cinch strap and be secured to one another to provide additional securement of the container to the saddle.

7 Claims, 2 Drawing Sheets

FLANK CINCH CONTAINER

BACKGROUND OF THE INVENTION

The present invention relates to a flank cinch container, and particularly a container which is adapted to be mounted to the flank cinch ring and flank cinch of a conventional western saddle.

Various devices have been provided for attachment to a saddle for carrying paraphernalia. Saddle bags are commonly used and are placed immediately behind the saddle.

However, it would be desirable to have a small container which can be easily reached by the person during the time the person is riding in the saddle.

Therefore, a primary object of the present invention is the provision of an improved container which can be attached to the flank cinch and flank cinch ring of the saddle.

A further object of the present invention is the provision of a container which can be easily attached or detached from the flank cinch ring and flank cinch.

A further object of the present invention is the provision of a container which can be easily reached by the person riding in the saddle.

A further object of the present invention is the provision of an improved container which is secured to the flank cinch ring and flank cinch strap in such a manner that it will be securely held against movement.

A further object of the present invention is the provision of a container which is economical to manufacture, durable in use, and efficient in operation.

SUMMARY OF THE INVENTION

The container of the present invention fits securely on any style of flank cinch. It includes a container capable of carrying accessory items such as cameras, sunglasses, soda, first aid items, and other small items. The container includes an upper strap which is adapted to pass around the cinch ring and to be secured to itself so as to attach the container to the cinch ring. The upper strap also includes a pair of securing members on its end which are adapted to wrap around the cinch strap immediately below the cinch ring so as to further secure the container to the cinch strap and cinch ring.

Spaced below the first upper strap are a pair of lower securing members which are adapted to wrap around the cinch strap below the upper strap, thereby providing further securement of the container to the cinch strap.

The various securing members are adapted to be secured together by means of cooperating hook members and loop members which are commercially available under the trademark "Velcro".

The device can be quickly and easily attached to the cinch strap and cinch ring of a western saddle, and it can also be removed easily by merely detaching the "Velcro" fasteners.

DESCRIPTION OF THE PREFERRED EMBODIMENT

Figure 1:
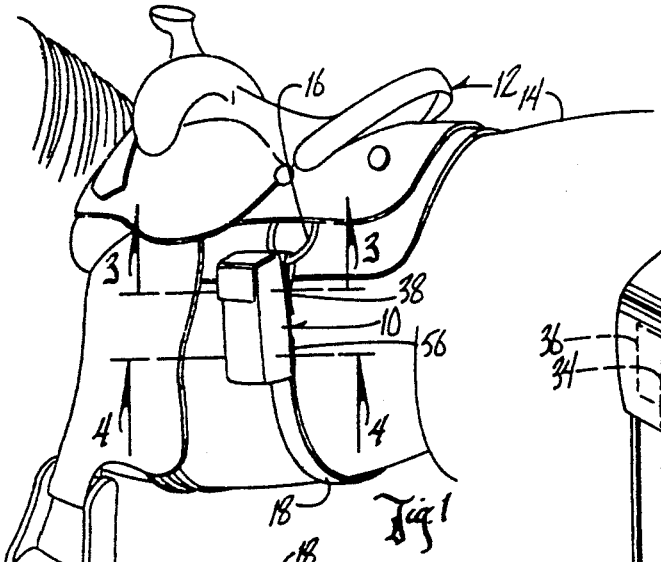
FIG. 1 is a perspective view showing a conventional western saddle mounted upon a horse and having the container of the present invention attached thereto.
Figure 2:
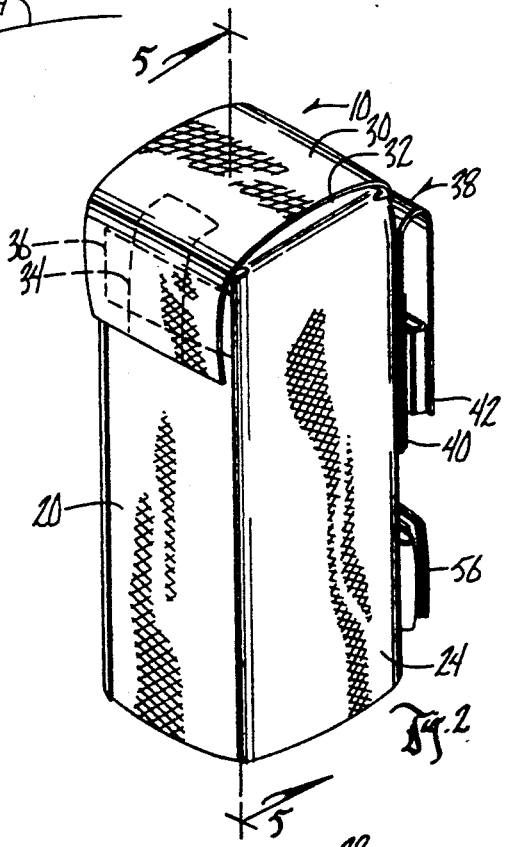
FIG. 2 is a perspective view of the container of the present invention.

Referring to the drawings, the numeral 10 generally designates the flank cinch container of the present invention. Container 10 is shown mounted upon a western saddle 12 which is on a horse 14. Saddle 12 includes a flank cinch ring 16 and a flank cinch strap 18 having its upper end connected to the cinch ring 16 and extending downwardly therefrom.

Container 10 includes a front wall 20, a rear wall 22, sidewalls 24, 26, and a bottom wall 28. The upper end of container 10 is provided with a top flap 30 which is adapted to fold in covering relationship over the top of the container to enclose the same. A pair of side flaps 32 are adapted to be folded inwardly underneath the top flap 30. The end of top flap 30 is provided with a hook member pad 34, and the front wall 20 is provided with a complementary loop member pad 36 so that the pads 34, 36 can be attached together to hold the top flap 30 in its closed position. The hook member pads 34 and the loop member pad 36 are commercially available under the trademark "Velcro".

Figure 3:
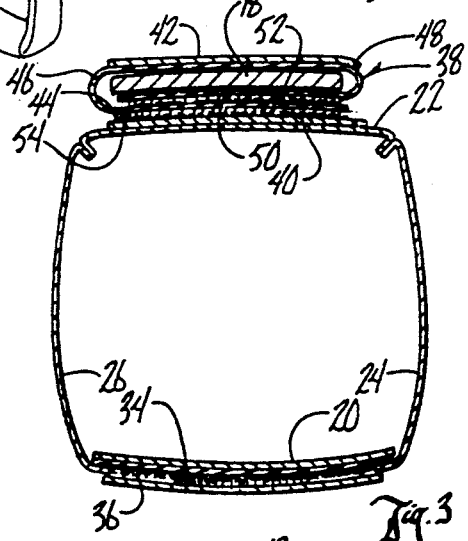
FIG. 3 is a sectional view taken along line 3—3 of FIG. 1.
Figure 4:
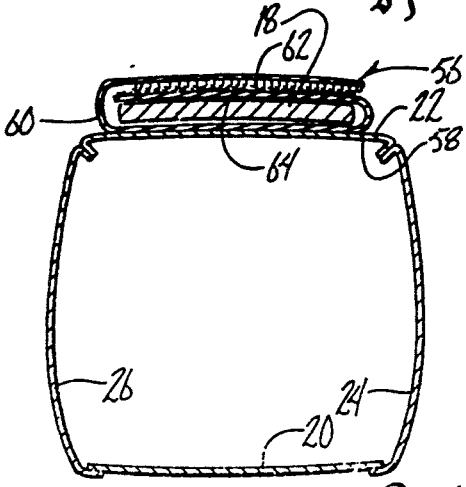
FIG. 4 is a sectional view taken along line 4—4 of FIG. 1.
Figure 5:
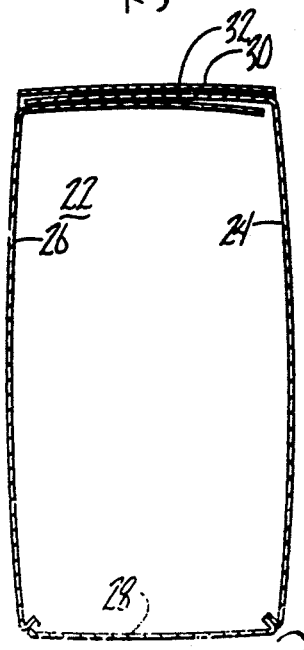
FIG. 5 is a sectional view taken along line 5—5 of FIG. 2.
Figure 6:
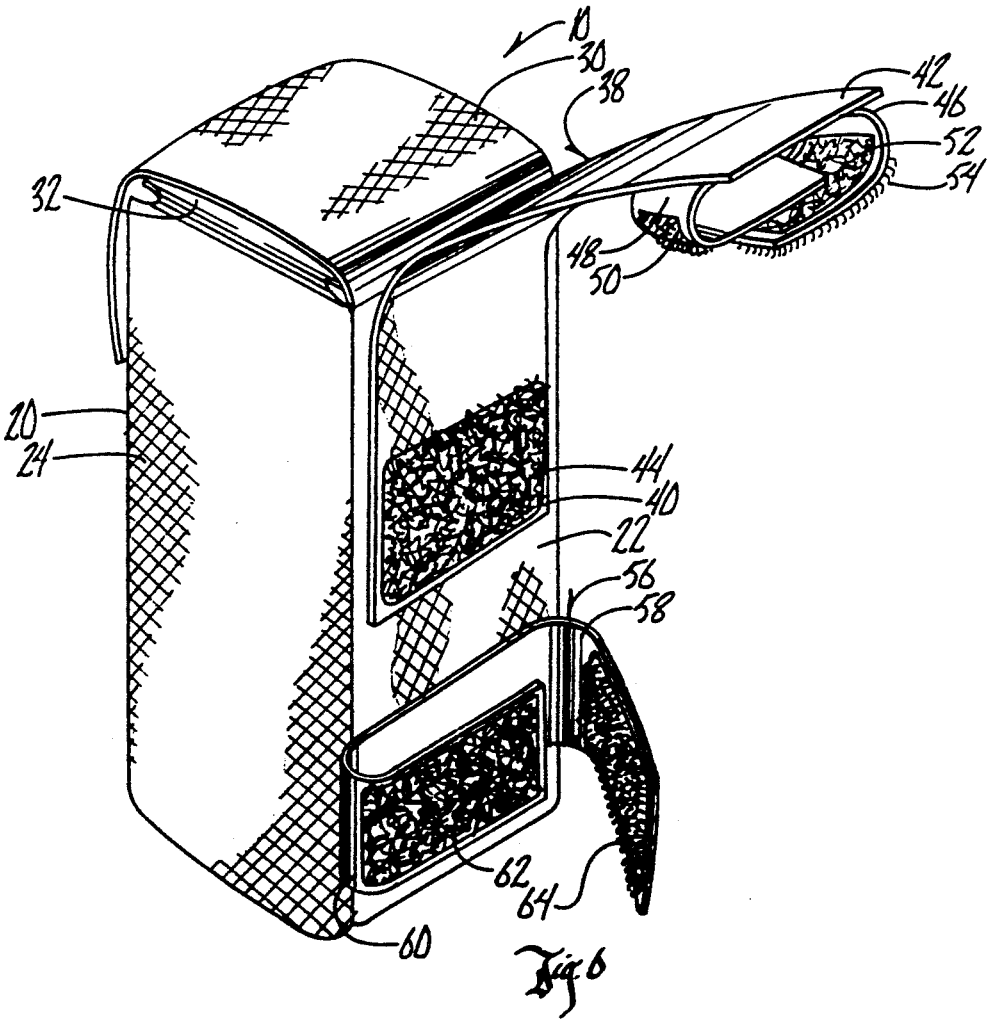
FIG. 6 is a perspective view of the container of the present invention.

Secured to the rear wall 22 of the container 10 adjacent the upper end thereof is a ring strap 38 which has a first end 40 secured to rear wall 22 and which has a second end 42. First end 40 is provided with a loop pad 44 having a plurality of loop members thereon. The second end of strap 38 includes a pair of securing members 46, 48. Securing member 48 is provided with a hook pad 50 on its outer surface, and securing member 46 is provided with a loop pad 52 on its inner surface and a hook pad 54 on its outer surface. To secure the container to the saddle, the second end 42 of ring strap 38 is passed through cinch ring 16 in the manner shown in FIG. 1. Securing members 46, 48 are then wrapped around the cinch strap 18 immediately below the cinch ring 16 as illustrated in FIG. 3. The securing members 46, 48 are then secured together by means of hook pad 50 and loop pad 52. The hook pad 54 which is on the exterior surface of securing member 46 is engaged with loop pad 44 on the first end 40 of cinch ring strap 38 so as to detachably secure the two together.

Also secured to the rear wall 22 and spaced downwardly therefrom is a lower securing means 56 comprised of a pair of lower securing members 58, 60. One of which has a hook pad 64 thereon, and the other of which has a loop pad 62 thereon. Securing members 58, 60 are wrapped around the cinch strap 18 adjacent the lower end of container 10 so as to prevent swinging movement of the container and provide further securement of the container to the cinch strap.

The container of the present invention can be quickly and easily attached to any conventional western saddle. Some saddles are provided with a flank cinch slot as opposed to a flank cinch ring, and the present invention can be attached to a saddle having a cinch slot in the same manner as it is attached to the cinch ring. Thus, it can be seen that the device accomplishes at least all of its stated objectives.

I claim:

1. A flank cinch container for use with a saddle having a flank cinch ring and a flank cinch connected to said cinch ring and extending downwardly therefrom, said container comprising:

a container body having a bottom wall, and at least one sidewall forming an enclosed storage compartment therein;

at least one of said top, bottom, and side walls being movable from a closed position enclosing said compartment to an open position providing access to said compartment from outside said compartment;

a first strap attached to said container body adjacent said top wall thereof, said first strap comprising first and second strap portions adapted to be placed in surrounding relation around said cinch ring and detachably secured together for attaching said container body to said cinch ring;

a second strap attached to said container below said first strap, said second strap comprising first and second strap portions positioned to be adjacent said flank cinch when said first strap is detachably secured to said cinch ring, said first and second strap portions of said second strap being adapted to be placed in surrounding relation to said flank cinch and detachably secured together so as to attach said container body to said flank cinch;

said second strap portion of said first strap having a free strap end;

a third strap being mounted on said free end of said second strap portion of said first strap and comprising third and fourth strap portions adapted to surround said cinch strap and be detachably secured together, said third and fourth strap portions being adapted to be detachably secured to said first portion of said first strap.

2. A flank cinch container according to claim 1 wherein said first portions of said first and second straps each include a plurality of hook members thereon, said second portions of said first and second straps each having a plurality of loop members thereon, said hook members and said loop members cooperating upon contact with one another to detachably secure said first and second portions of said first and second straps together, respectively.

3. A flank cinch container according to claim 1 wherein said container body includes a front sidewall, a rear side wall, and two opposite sidewalls so as to create a rectangular cross sectional configuration to said container body.

4. A flank cinch container according to claim 3 wherein said at least one movable wall comprises a flap having one flag edge which is hinged to said container body and having a second flap edge adapted to fold to said closed position and overlap with one of said side walls of said container body, a plurality of hook members being on one of said second flap edge and said one side wall and a plurality of loop members being on the other of said second flap edge and said one side wall for detachably securing said flap in said closed position.

5. A flank cinch according to claim 4 wherein said at least one movable wall is said top wall and said one side wall is said front sidewall, said one flap edge being hinged to said rear sidewall.

6. A flank cinch according to claim 5 wherein said first and second straps are both attached to said rear sidewall.

7. In combination:

a saddle having a flank cinch ring and a flank cinch strap, said strap having an upper end secured to said cinch ring and extending downwardly therefrom in a general vertical direction;

a container body having an upper end and a lower end and having a plurality of walls forming an enclosed storage compartment therein, one of said walls comprising a flap adapted to fold from an open position providing an access opening to said storage compartment to a closed position closing said access opening;

a first strap secured to the outside of said container body adjacent said upper end thereof, said first strap having opposite ends extending around said cinch ring and being detachably secured together;

a second strap secured to the outside of said container body in spaced relation below said first strap, said second strap having opposite ends extending around said cinch strap below said ring and being detachably secured together;

a third strap being connected to one of said opposite ends of said first strap and surrounding said cinch strap below said cinch ring and above said second strap, said third strap also being detachably secured to the other of said opposite ends of said first strap.

* * * * *

UNITED STATES PATENT AND TRADEMARK OFFICE

CERTIFICATE OF CORRECTION

PATENT NO. : 5,154,042

DATED : 10-13-92

INVENTOR(S) : Mooney, Scott M.

It is certified that error appears in the above-indentified patent and that said Letters Patent is hereby corrected as shown below:

Column 3, line 5, after "wall," insert --a top wall,--.

Column 4, line 5, delete "flag" and insert --flap--.

Signed and Sealed this

Fourteenth Day of September, 1993

*Attest:*

*Attesting Officer*

BRUCE LEHMAN

*Commissioner of Patents and Trademarks*